United States Patent [19]

Justus et al.

[11] 4,126,513

[45] Nov. 21, 1978

[54] AIR DOME ATTENUATOR

[75] Inventors: Edgar J. Justus, Beloit, Wis.; Carl B. Dahl, Rockton, Ill.

[73] Assignee: Beloit Corporation, Beloit, Wis.

[21] Appl. No.: 811,959

[22] Filed: Jun. 30, 1977

[51] Int. Cl.[2] ..... B07B 1/20; D21F 1/00

[52] U.S. Cl. ..... 162/380; 209/273; 209/306

[58] Field of Search ..... 209/273, 305, 306, 270, 209/255-257, 379, 380, 389; 210/415, 497 R; 162/380

[56] References Cited

U.S. PATENT DOCUMENTS

| | | | |
|---|---|---|---|
| 3,376,976 | 4/1968 | Wallen | 209/273 |
| 3,387,708 | 6/1968 | Salomon et al. | 209/273 |
| 3,589,980 | 6/1971 | Salomon | 209/273 X |
| 3,672,506 | 6/1972 | Syrjanen | 209/273 |

*Primary Examiner*—Frank W. Lutter
*Assistant Examiner*—Ralph J. Hill
*Attorney, Agent, or Firm*—Hill, Gross, Simpson, Van Santen, Steadman, Chiara & Simpson

[57] ABSTRACT

A method and mechanism including a housing having a screening chamber therein with a cylindrical screen and foils rotating past the surface of the screen with the housing having circumferentially spaced outlets which are at nonuniform circumferential locations, are different in number than the foils, and lead to a common manifold which will lead to a paper machine headbox. An air dome is at one end of the chamber.

12 Claims, 3 Drawing Figures

P
52
51
49
16
17
18
III
48
54
53
II
50
II
12
P
10
11
15
14
40
13
44
42
30
19
41
III
43
39
47
45
46

AIR DOME ATTENUATOR

BACKGROUND OF THE INVENTION

The invention relates to improvements in paper making machines and more particularly to a stock screen for screening the stock prior to its entering the headbox wherein the pulsations in the stock caused by the rotating foils are damped to prevent the pulsations from causing disturbances in the headbox flow.

In a paper making machine, stock is delivered under pressure to a headbox from which it is discharged onto a traveling foraminous surface for dewatering and web formation. It is essential and critical to uniform operation and good formation of the web that pulsations and pressure in the headbox be avoided. One source of such pulsations occurs in the screening chamber through which the stock flows prior to delivery to the headbox for the purpose of cleaning the stock and removing undesirable foreign particles such as dirt, bark, slivers and other material. Such screening chambers conventionally have a cylindrically shaped screen through which the stock flows, and in order to maintain flow through the screen and prevent the screen from being clogged, one or more foils are continuously passed at uniform speed over the surface of the screen to cause a pressure pulsation. While such pressure pulsation is necessary to the satisfactory operation of the screen, it introduces a pressure pulsation which is felt in the stock delivery to the headbox. Such pressure pulsations will disturb uniform distribution of the stock and will have an adverse effect on flow of the stock through the slice opening onto the forming surface, and it is essential to satisfactory high speed operation and good formation that the fluctuations be essentially eliminated.

It is accordingly an object of the present invention to provide an improved paper making machine with a stock screening device in the flow supply to the headbox which does not emit pressure fluctuations and pulsations that would be deleterious to good stock distribution and flow through the headbox.

A still further object of the invention is to provide an efficient effective paper stock screening apparatus using a cylindrical screen with a rotating foil wherein pressure fluctuations inherent with the operation of the foil are effectively damped and eliminated.

A further general object of the invention is to provide an improvement in a paper making machine having screening apparatus with an improved screening structure.

Other objects, advantages and features, as well as equivalent structures and methods which are intended to be covered herein, will become more apparent with the teaching of the principles of the present invention in connection with the disclosure of the preferred embodiment in the specification, claims and drawings, in which:

DRAWINGS

DESCRIPTION

Figure 1:
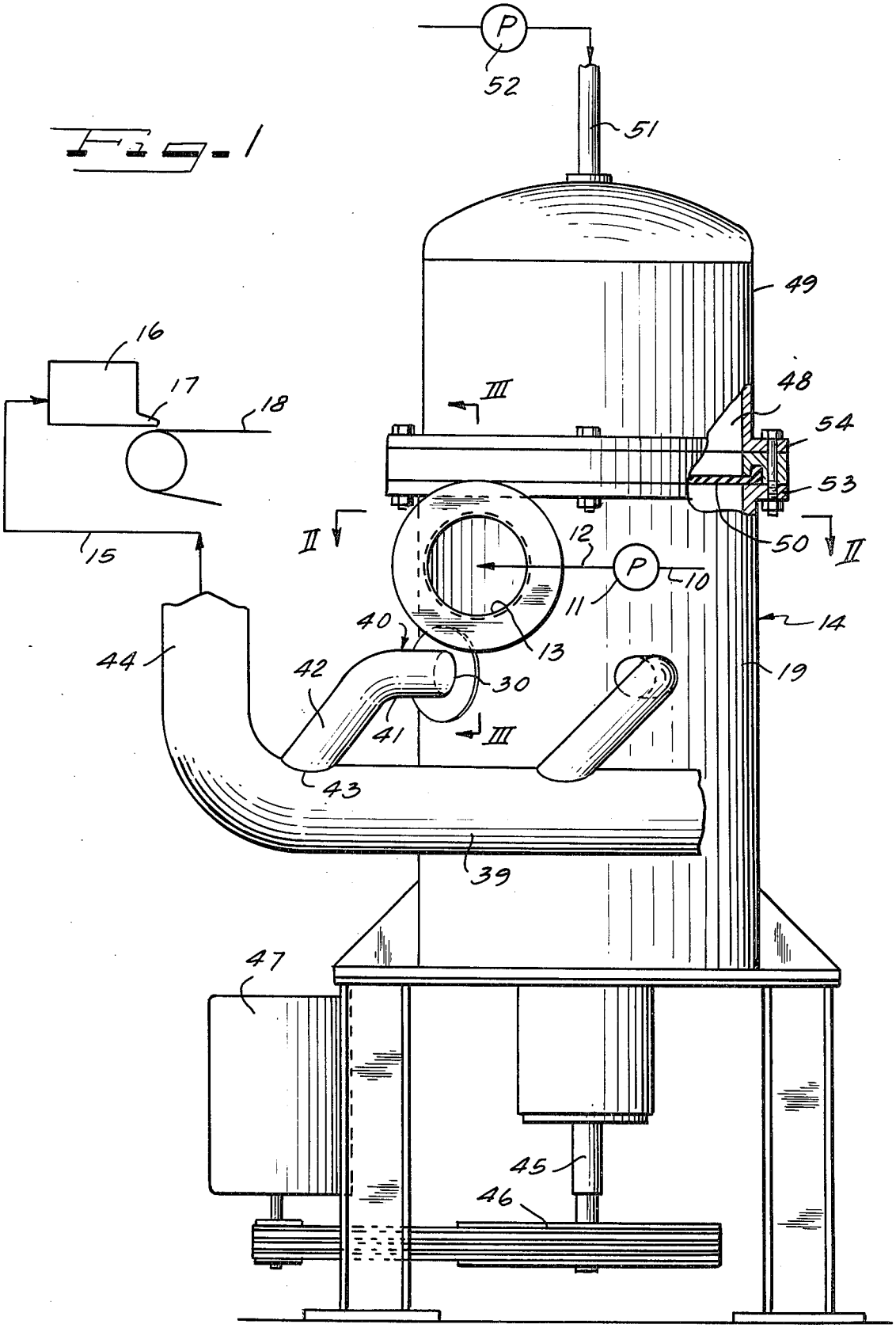
FIG. 1 is an elevational view, with portions broken away illustrating a paper machine screen constructed and operating in accordance with the principles of the present invention.

As shown in the drawings, a screening mechanism is provided of the type which is used for final screening immediately prior to the stock entering the headbox. As shown in FIG. 1, a stock supply of the proper consistency is received through a line 10 and passes through a fan pump 11 through a connecting line 12 to an inlet 13 for a screening mechanism having a housing 14. The stock flows through the screening mechanism and exits through an outlet line 15 to a headbox 16 to flow out through a slice opening 17 onto a traveling forming wire 18.

Figure 2:
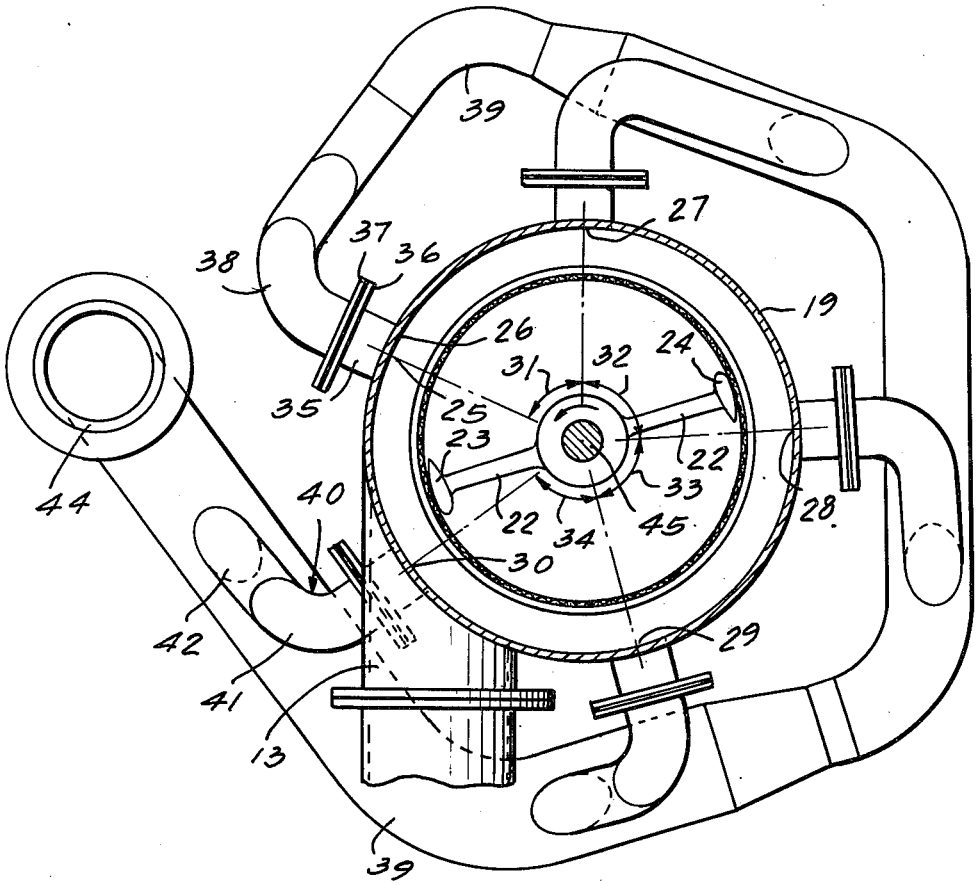
FIG. 2 is a horizontal sectional view taken substantially along line II—II of FIG. 1.
Figure 3:
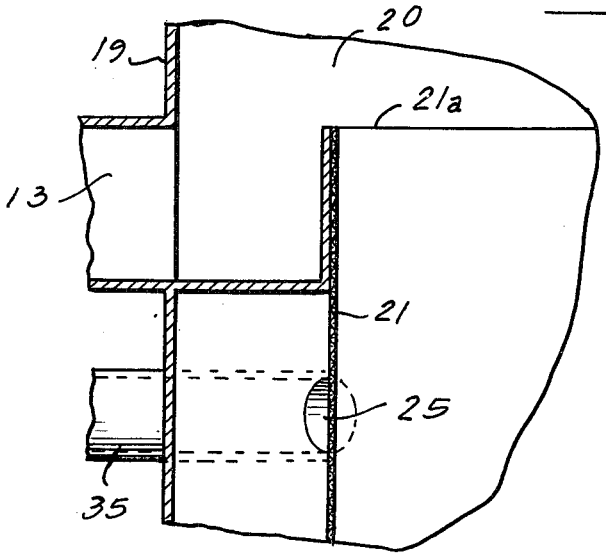
FIG. 3 is a fragmentary sectional view taken substantially along line III—III of FIG. 1.

The housing 14 of the screening mechanism is preferably cylindrical in shape and has a cylindrical outer wall 19, FIG. 2, with a cylindrical screen 21 therein. As illustrated in FIG. 3, the stock flows into the inlet 13 which leads tangential into the housing and flows around an annular chamber 20 over the top edge **21*a* and into the interior of the screen. The stock is screened with the stock flowing radially outwardly through the screen, and to avoid buildup of fibers and dirt on the inner surface of the screen and to cause continuous flow, a foil unit 22 is continually rotated within the screen. The foil unit has radial arms with tear drop shaped foils 23 and 24** at the ends of the arms which are moved along the screen and cause pulsations on the screen surface as they move. These pulsations are ideal for maintaining constant flow through the screen and maintaining the screen clean, but such pulsations are transmitted through the stock to the headbox in normal constructions of the type heretofore used. In the present arrangement, these pressure pulsations are damped in a unique manner so that they are substantially self-cancelling, and the pulsations are not felt in the headbox.

At the top of the housing 19 is an air dome 48. For convenience, the housing has an annular flange 53 and a corresponding flange 54 permits bolting the air dome in place and a diaphragm 50 is clamped between the flanges to extend across the circular area between the air chamber 49 and the interior of the housing within the screen. Air within the chamber 49 is maintained essentially at the pressure of the stock being delivered through the system, and for this purpose an air inlet line 51 is connected to the air dome to supply air from an air pump 52 from which the pressure is regulated.

Thus, pulsations within the screen caused by the moving foils are damped upstream of the screen by the elasticity of the air in the air dome. The dampening of the back wave of pressure prevents the inducing of a pressure wave in the entering stock, and greatly reduces the pressure pulsations that normally would be felt and transmitted through the screen to the headbox.

The pressure in the system is usually controlled by operation of the fan pump 11, and if desired an automatic pressure control can be connected from the fan pump 11 to the air pump 52 so that as fan pump pressure is changed, the air dome pressure is automatically changed commensurately.

During normal operation, the foils are rotated at a constant speed, and for this purpose the foil assembly is mounted on a center shaft 45 (FIG. 1) which is driven in rotation through drive belts and sheaves 46 from a foil drive motor 47.

As the stock flows through the screen, rejects such as dirt, bark and slivers flow downwardly within the screen to be taken off from a reject outlet at the bottom of the screen, which for convenience is not shown. The rejects are generally reprocessed for recovery of fibers rejected along with the rejected foreign objects.

The stock which passes through the screen flows out of the annular chamber outside of the screen through a series of circumferentially spaced outlets, shown at 26, 27, 28, 29 and 30. These outlets are nonuniformly spaced in the circumferential direction so that the pulsations of the foils will be nonuniformly spaced with respect to the time interval at which the foil passes the outlet. The outlets lead to a common manifold 39 which extends annular around the screen housing 19, and the intermittent pulsations are essentially self-cancelling in the manifold. That is, the pressure pulsations are not uniformly timed with respect to each of the openings, but are nonuniformly timed so that the peak pressure wave out of one opening will match a decaying pressure wave or a negative pressure wave from another opening so that the pulsations cancel each other. Openings 26 and 27 are set apart by an angle 31, openings 27 and 28 are set apart by a different angle 32, openings 28 and 29 are set apart by a still different angle 33, and openings 29 and 30 are set apart by a still different angle 34. The sequential angles from the first opening 25 which leads into the head end of the manifold 39 may diminish in size, may increase in size, or may be staggered so that each is different.

It is significant that the number of outlet openings is different than the number of foils. In the present arrangement, two foils are shown at 23 and 24 positioned diametrically opposite each other. Five outlets are used, and being an uneven number, they are spaced so that two foils are never opposite two outlets at the same time. This means that as the pressure wave from the foil passes into one of the outlets, the other foil will not be opposite an outlet so that there will not be two pressure pulsation waves fed into the manifold through the outlets at the same time. As will be appreciated by those versed in the art from the foregoing description, different numbers of foils and different numbers of outlets may be employed following the principles of spacing outlets and foils so that at no time is there more than one foil opposite one outlet at a time. The arrangement of two foils with five outlets is the preferred arrangement, although different arrangements may be employed within the principles of the invention.

Each of the outlet openings has a generally similar physical construction with the outlet opening, as shown at 26, being formed through the housing wall 19 and having a pipe hub 35 with a flange 36 thereon. An outlet conduit 38 is similarly flanged with a flange 37 which connects to the flange 36. The outlet conduit 38 first turns essentially at a right angle downwardly to lead to the manifold which is preferably positioned at a level below the outlets. The outlet conduit then angles so that the flow of stock into the annular manifold is smooth. This construction is also illustrated in FIG. 1 by the last outlet opening 30. The opening has an outlet pipe 40 which leads to a right angle elbow 41 extending downwardly, and an extension 42 from the elbow extends angularly to join the manifold 39 at an angle as shown at 43. As is illustrated in FIG. 2, each of the outlet conduits is similarly constructed and for purposes of simplicity, only one need be described in detail. For uniformity of flow, the manifold 39 increases in cross-sectional dimension in a clockwise direction toward the direction of flow with the cross-sectional size at each juncture with the outlet being increased to accommodate the additional flow of the outlet. In this manner the flow through each of the outlets will be substantially uniform which aids in the self-cancelling effect, although it is not essential that the outlets be of uniform cross-sectional size.

With five outlets being employed, each outlet is one-fifth the size of the manifold size at the location where it flows to the headbox generally at the location of numeral 44, FIG. 1.

The manifold then turns through a bend, as shown at 44 in FIG. 1 to lead to the conduit 15 leading to the headbox, and the headbox usually will be provided with distributors and known construction for preventing flocculation and insuring uniform fiber distribution and flow through the headbox.

Thus, it will be seen that I have provided an improved screening system which meets the objectives and advantages above set forth and will result in an improved quality of paper because final screening can occur immediately in advance of the headbox without the heretofore attendant disadvantages of pulsations being transmitted to the headbox. The pressure surge dampening effect of the air dome immediately in advance of the screen, centered with respect to the screen so that its effect is uniform throughout the circumference thereof, and the self-cancelling effect of the outlets further eliminates the pulsation effect of the foils.

I claim as my invention:

1. A paper making machine screen for processing stock flowing to a headbox comprising in combination:

a housing defining a screening chamber therein having an inlet for receiving the stock;

a cylindrical screen within the chamber for passing stock to the outer wall of the chamber;

a foil means having one or more foils mounted for rotating at a uniform speed of travel along said screen for generating pulsations in the stock passing through the screen;

a foil drive for moving the foil means along the screen;

a plurality of outlets arranged circumferentially around the outer wall of the housing receiving stock after it has passed through the screen;

and a manifold for leading to a headbox having said outlets connected thereto and structurally positioned relative to the number and position of foils so that the pulsations of the foil means tend to be self-cancelling in the manifold.

2. A paper making machine screen for processing stock flowing to a headbox constructed in accordance with claim 1:

wherein said outlets are unevenly circumferentially spaced at unequal distances apart for successive outlets to be located at unequal time phases relative to rotation of the foil means.

3. A paper making machine screen for processing stock flowing to a headbox constructed in accordance with claim 1:

wherein said outlets are provided with an elbow so as to require a turn in the flow of stock from the outlet to the manifold.

4. A paper making machine screen for processing stock flowing to a headbox constructed in accordance with claim 1:

wherein the manifold is positioned below said outlets and the outlets are provided with conduits with multiple turns which turn downwardly and then turn in the direction of flow through the manifold.

5. A paper making machine screen for processing stock flowing to a headbox constructed in accordance with claim 1:

including a fan pump connected to deliver stock to the screen and a connection leading from the manifold to a headbox of a paper machine.

6. A paper making machine screen for processing stock flowing to a headbox constructed in accordance with claim 1:

and including an air dome at one end of the housing for containing a quantity of air exposed to the stock in the chamber dampening pressure pulsations of the foil means.

7. A paper making machine screen for processing stock flowing to a headbox comprising in combination:

a housing defining a screening chamber therein having an inlet for receiving stock;

a cylindrical screen within the chamber for passing stock to the outer wall of the chamber;

a foil means mounted for rotating at a uniform speed of travel along said screen for generating pulsations in the stock passing through the screen;

a foil drive for moving the foil means along the screen;

conduit means leading from the housing for connecting to a paper machine headbox;

and an air dome at one end of the housing for containing a quantity of air exposed to the stock in a chamber dampening pressure pulsations of the foil means.

8. A paper making machine screen for processing stock flowing to a headbox constructed in accordance with claim 7:

including a diaphragm extending between the air in the air dome and the stock in said housing.

9. A paper making machine screen for processing stock flowing to a headbox constructed in accordance with claim 8:

including means connected to the air dome for controlling the pressure of the air therein to obtain a constant predetermined pressure.

10. The method of dampening pressure pulsations in stock passing through a screening chamber having a housing with a cylindrical screen therein and foil means rotating past the screen for causing pressure pulsations which comprises removing accepted stock from the housing after it has been screened at different circumferential locations with said circumferential locations being unequal distances apart for successive locations.

11. The method of dampening pressure pulsations in stock passing through a screening chamber having a housing with a cylindrical screen therein and foil means rotating past the screen for causing pressure pulsations in accordance with claim 10 and including flowing stock through the screening chamber and absorbing pressure pulsations by having a chamber of compressed air located at one end of the housing exposed to the stock within the chamber with the air pressure maintained at a predetermined controlled uniform pressure.

12. A paper making machine screen for processing stock flowing to a headbox comprising in combination:

a housing defining a screening chamber therein having an inlet for receiving stock;

a cylindrical screen within the chamber for passing stock to the outer wall of the chamber;

a plurality of foils mounted for rotating at a substantially uniform speed of travel along said screen and generating pulsations in the stock passing through the screen;

a foil drive for moving the foils along the screen;

a plurality of outlets arranged circumferentially around the outer wall of the housing receiving accepted stock after it has passed through the screen with said outlets being positioned so that at no time will a plurality of foils be opposite a plurality of outlets;

and a manifold connected for receiving accepted stock from the outlets.

* * * * *